US005092585A

United States Patent [19]

Jones

[11] Patent Number: 5,092,585

[45] Date of Patent: * Mar. 3, 1992

[54] APPARATUS FOR TESTING AND/OR EXERCISING THE CERVICAL MUSCLES OF THE HUMAN BODY

[76] Inventor: Arthur A. Jones, 1155 NE. 77th St., Ocala, Fla. 32670

[ * ] Notice: The portion of the term of this patent subsequent to Mar. 26, 2008 has been disclaimed.

[21] Appl. No.: 608,753

[22] Filed: Nov. 5, 1990

Related U.S. Application Data

[63] Continuation of Ser. No. 307,473, Feb. 8, 1989, Pat. No. 5,002,269, which is a continuation-in-part of Ser. No. 60,679, Jun. 11, 1987, Pat. No. 4,836,536, said Ser. No. 307,473, is a continuation-in-part of Ser. No. 236,367, Aug. 25, 1988, Pat. No. 4,902,009, which is a continuation-in-part of Ser. No. 60,679, Jun. 11, 1987, Pat. No. 4,836,536, said Ser. No. 307,473, and a continuation-in-part of Ser. No. 181,372, is a continuation-in-part of Ser. No. 60,679, Jun. 11, 1987, Pat. No. 4,836,536.

[51] Int. Cl.[5] ..... A63B 23/025

[52] U.S. Cl. ..... 272/94; 272/118; 272/134

[58] Field of Search ..... 272/93, 94, 117, 118, 272/128, 129, 134, 144; 128/25 R; 73/379

[56] References Cited

U.S. PATENT DOCUMENTS

| | | | |
|---|---|---|---|
| 4,333,340 | 6/1982 | Elmeskog | 272/134 X |
| 4,462,252 | 7/1984 | Smidt et al. | 272/134 X |
| 4,538,805 | 9/1985 | Parviainen | 272/118 |
| 4,600,189 | 7/1986 | Olschansky et al. | 272/118 |
| 4,621,807 | 11/1986 | Stramer | 272/117 |
| 4,628,910 | 12/1986 | Krukowski | 128/25 R |
| 4,635,933 | 1/1987 | Schnell | 272/129 |
| 4,645,205 | 2/1987 | Wolff | 272/143 |
| 4,733,859 | 3/1988 | Kolk et al. | 272/94 X |
| 4,763,897 | 8/1988 | Yakata | 272/118 |
| 4,765,315 | 8/1988 | Krukowski | 128/25 R |
| 4,768,779 | 9/1988 | Oehman, Jr. et al. | 272/94 |
| 4,787,375 | 11/1988 | Krause | 272/144 X |
| 4,846,458 | 7/1989 | Potts | 272/65 |
| 4,858,919 | 8/1989 | Jones | 272/134 |
| 5,002,269 | 3/1991 | Jones | 272/94 |

OTHER PUBLICATIONS

Roughneck Publication-Coach & Athlete, p. 27, published Nov. 12, 1981.

*Primary Examiner*—Robert Bahr
*Attorney, Agent, or Firm*—William E. Mouzavires

[57] ABSTRACT

Apparatus for exercising and/or testign the cervical muscles of the neck wherein a seated person is secured against a backrest to isolate movement of his head and neck from the remainder of his body. For exercising the cervical muscles between opposite positions of full extension and flexion, the muscles are used to move the head rearwardly against a pivotable movement arm to move the later against a yieldable resistance weight connected to the movement arm to bias the movement arm in one direction. The head is then moved forwardly and the process is repeated until the movement arm can no longer be moved by said muscles. The number of repetitions is measured and recorded throughout the exercise. In another mode of the apparatus, the static strength of said muscles is measured at several angular positions of the neck by fixing the movement arm against movement in each position and having the person exert said muscles to press the head rearwardly against the movement arm during which the force exerted by said muscles is measured and recorded.

11 Claims, 6 Drawing Sheets

APPARATUS FOR TESTING AND/OR EXERCISING THE CERVICAL MUSCLES OF THE HUMAN BODY

RELATED APPLICATIONS

This application is a continuation of my prior copending application, Ser. No. 07,307,473 filed Feb. 8, 1989, now U.S. Pat. No. 5,002,269 which in turn is a continuation-in-part of my prior copending application, Ser. No. 07,060,679, filed June 11, 1987 entitled "Method and Apparatus for Testing or Exercising Muscles of the Lower Trunk of the Human Body" and which issued into U.S. Pat. No. 4,836,536. Parent application 07,307,473, filed Feb. 8, 1989 now U.S. Pat. No. 5,002,269 identified above is also a continuation-in-part of my prior application, Ser. No. 07,236,367, now U.S. Pat. No. 4,902,009 filed Aug. 25, 1988 and entitled "Machine for Exercising And/Or Testing Muscles Of The Lower Trunk and Method" which, in turn, is a continuation-in-part of my aforesaid application, Ser. No. 07,060,679, filed June 11, 1987, now U.S. Pat. No. 4,836,536 . Parent application 07,307,473 filed Feb. 8, 1989 now U.S. Pat. No. 5,002,269 identified above is also a continuation-in-part of my prior application, Ser. No. 07,181,372, now U.S. Pat. No. 4,834,365 filed Apr. 14, 1988, entitled "Compound Weight System" which, in turn, is a continuation-in-part of my application, Ser. No. 07,060,679 filed June 1, 1987, now U.S. Pat. No. 4,836,536 identified above.

BACKGROUND OF INVENTION

The prior art includes various devices for exercising the neck muscles wherein weights are applied to head gear and the subject, wearing the head gear, moves his head back and forth to exercise the neck. Such devices are shown, for example, in U.S. Pat. Nos. 2,051,366 Catron, 2,855,202 Kinne, 4,219,193 Newman and 4,339,124 Vogler.

The pertinent art has developed from the aforesaid devices to apparatus where the subject, while in a standing position, moves his head against a movement arm against a resistance such as a shock absorber cylinder as disclosed in U.S. Pat. No. 4,066,259 Brentham or a friction brake as disclosed in U.S. Pat. No. 4,278,249 Forrest or a weight fixed to the movement arm as disclosed in U.S. Pat. No. 4,302,055 Silverman. However, in each of these prior art devices the subject, during the exercise, is in a standing position with his arms being free to apply leverage or forces to a frame such as in Forrest and Brentham. Such action may aid the neck muscles such that the neck muscles are not entirely isolated to provide pure neck muscle exercise. In these circumstances, it is difficult to obtain accurate measurement of the strength or performance of the neck muscles per se. While Brentham attempts to immobilize the lower torso, he provides no restraint of the back and seat of the subject and the subject's arms are free to push-off the frame of the device. Moreover, with these devices, no attempt is made to counterbalance the mass and weight of the subject's head which provision must be made if accurate testing or exercise of the neck muscles per se is to be achieved.

OBJECTS OF THE PRESENT INVENTION

The present invention relates to methods and apparatus for exercising and/or testing the cervical muscles of the human neck.

An object of the present invention is to provide novel and improved methods and apparatus for conducting static or dynamic strength tests and exercise of the cervical muscles of the human neck.

Another object of the present invention is to provide novel and improved methods and apparatus for testing and/or exercising the cervical muscles of the human neck with efficiency, accuracy and safety. Included herein are such methods and apparatus which rely on a freely yieldable safe resistance to oppose movement of the neck in contrast to isokinetic or constant velocity loading methods which may impose a risk of injury to the neck.

Another object of the present invention is to provide novel and improved apparatus for exercising and/or testing the neck muscles in a manner which positions the subject in an improved manner to simplify the exercise while also increasing the accuracy of the results.

Another object of the present invention is to provide a need and improved method and apparatus for testing and/or exercising the neck muscles of a person while the person is seated and secured against a backrest to immobilize the upper torso at the chest and shoulder areas and upper arm portions to isolate the neck muscles so that they will not be aided by other muscles of the person during testing or exercise.

A further object of the present invention is to provide novel and improved apparatus for exercising and/or testing the neck muscles which apparatus is relatively easy to operate while allowing accurate recorded measurement of the strength of the neck muscles.

SUMMARY OF INVENTION

In accordance with a preferred form of the present invention, a subject is seated with his torso immobilized against a backrest to isolate the subject's neck from the upper torso. The back of the subject's head is positioned against a movement arm pivotable about a generally horizontal axis and biased against movement in a rearward direction by a freely yieldable resistance weight which is safety less in magnitude than the static strength of the cervical muscles. The subject's cervical muscles produce a force to cause the head to move rearwardly to pivot the movement arm rearwardly against the resistance weight which is lifted as the movement arm is pivoted rearwardly. The subject's head is then moved forwardly causing the movement arm under the force of the resistance weight to pivot forwardly as the resistance weight descends. The exercise is repeated until the subject is no longer able to pivot the movement arm rearwardly. As the exercise proceeds, the dynamic strength of the cervical muscles is measured and recorded.

To test the static strength of the cervical muscles, the movement arm is fixed in several different angular positions and in each position the subject exerts with the cervical muscles, a force pressing the head rearwardly against the movement arm, and the magnitude of the force is measured and recorded. Once the static strength of the subject's cervical muscles is determined, a safe resistance weight less than the static strength of the muscles, is chosen to be used in the dynamic test or exercise summarized above. Improved apparatus for carrying out the above methods with safety and accuracy is described below.

DRAWINGS

Other objects and advantages of the present invention will become apparent from the following detailed description taken in conjunction with the attached drawings in which.

Figure 2A:
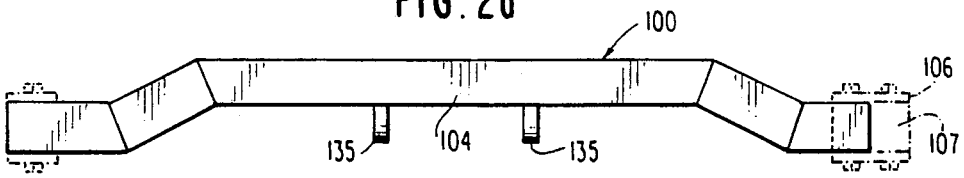
FIG. 2 is a view generally similar to FIG. 1 but showing a front pad in fully retracted position and with certain other parts removed.
Figure 2:
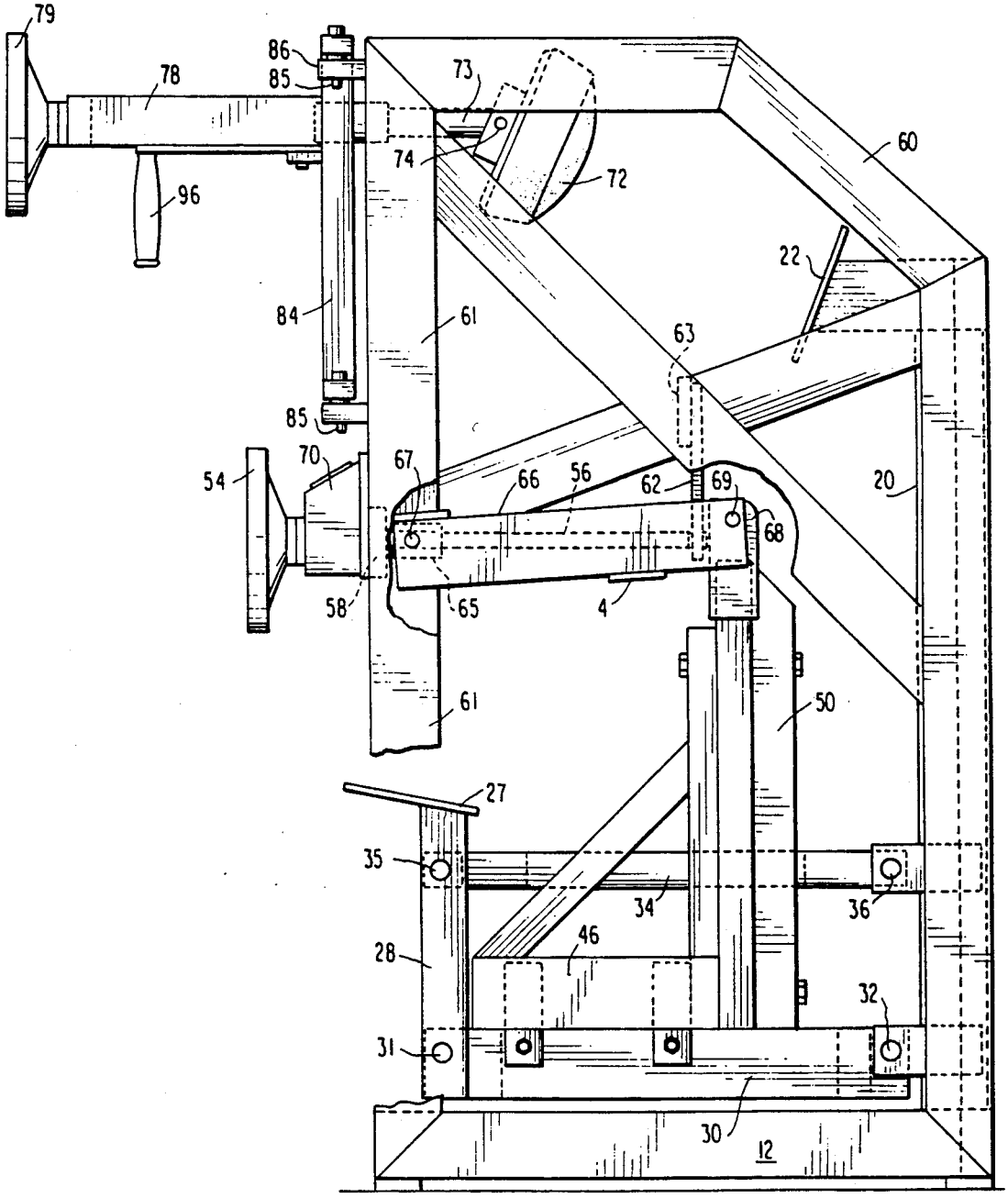
Figure 3:
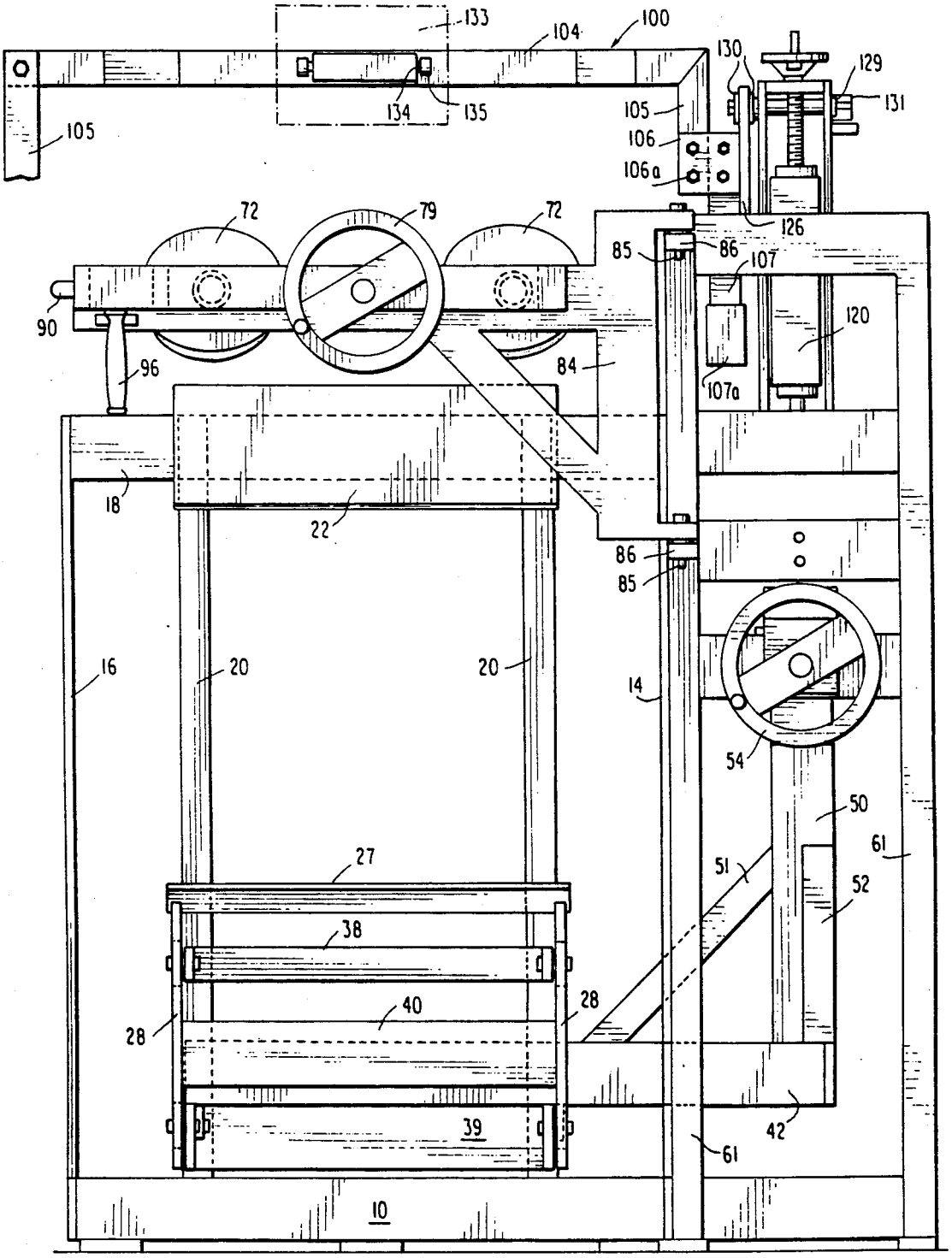
Figure 4:
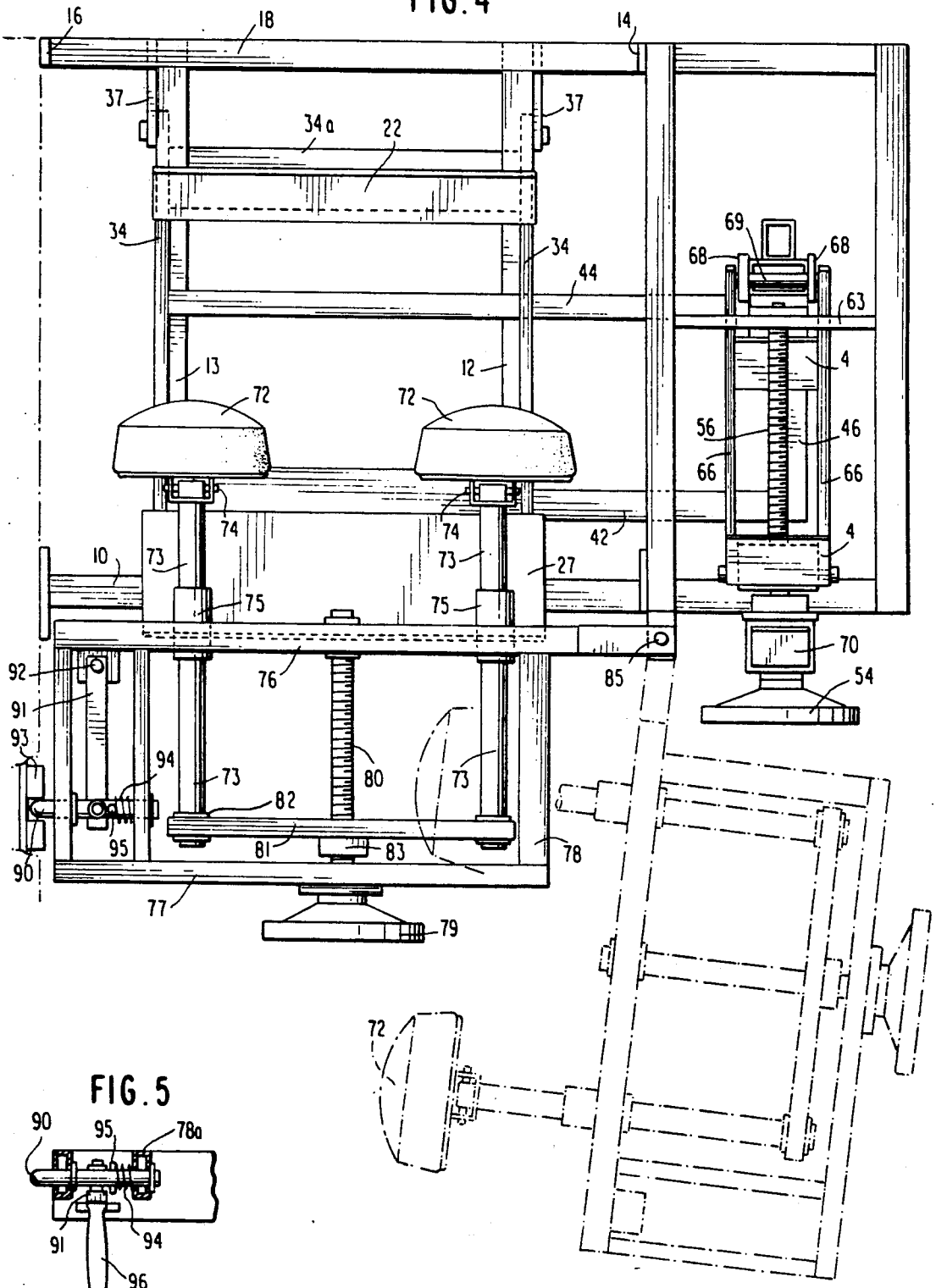
Figure 5:
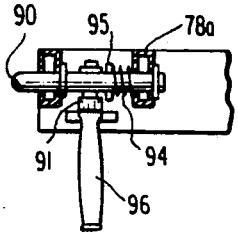
Figure 6:
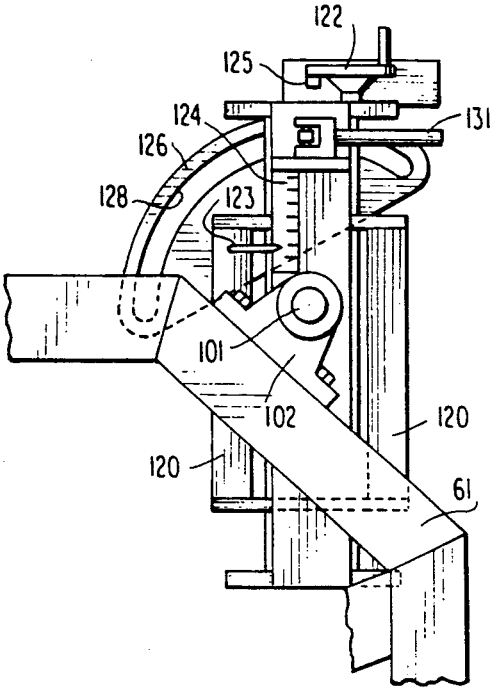
Figure 7:
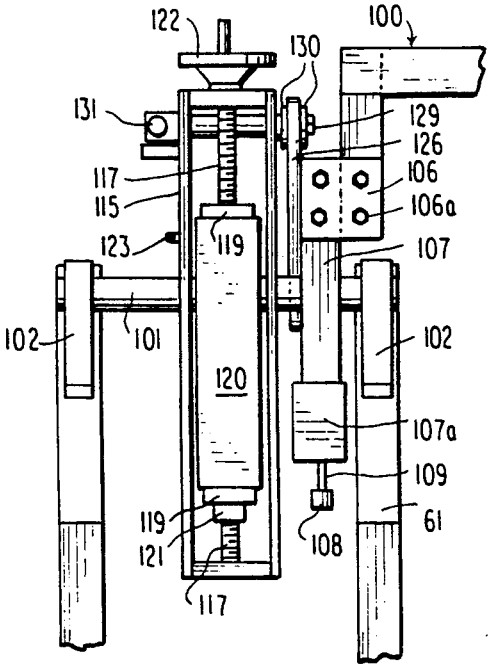
Figure 8:
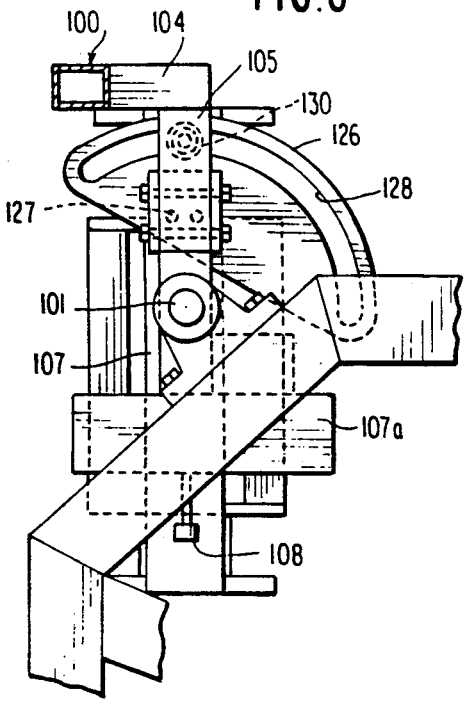
Figure 9:
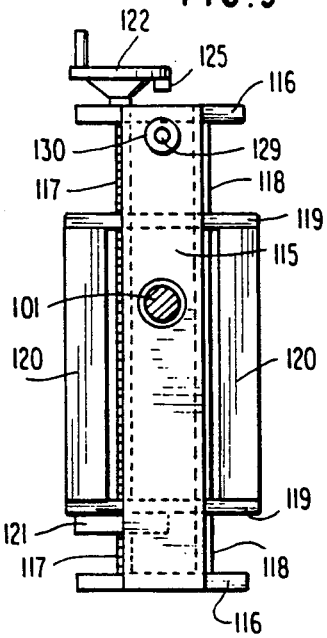
Figure 10:
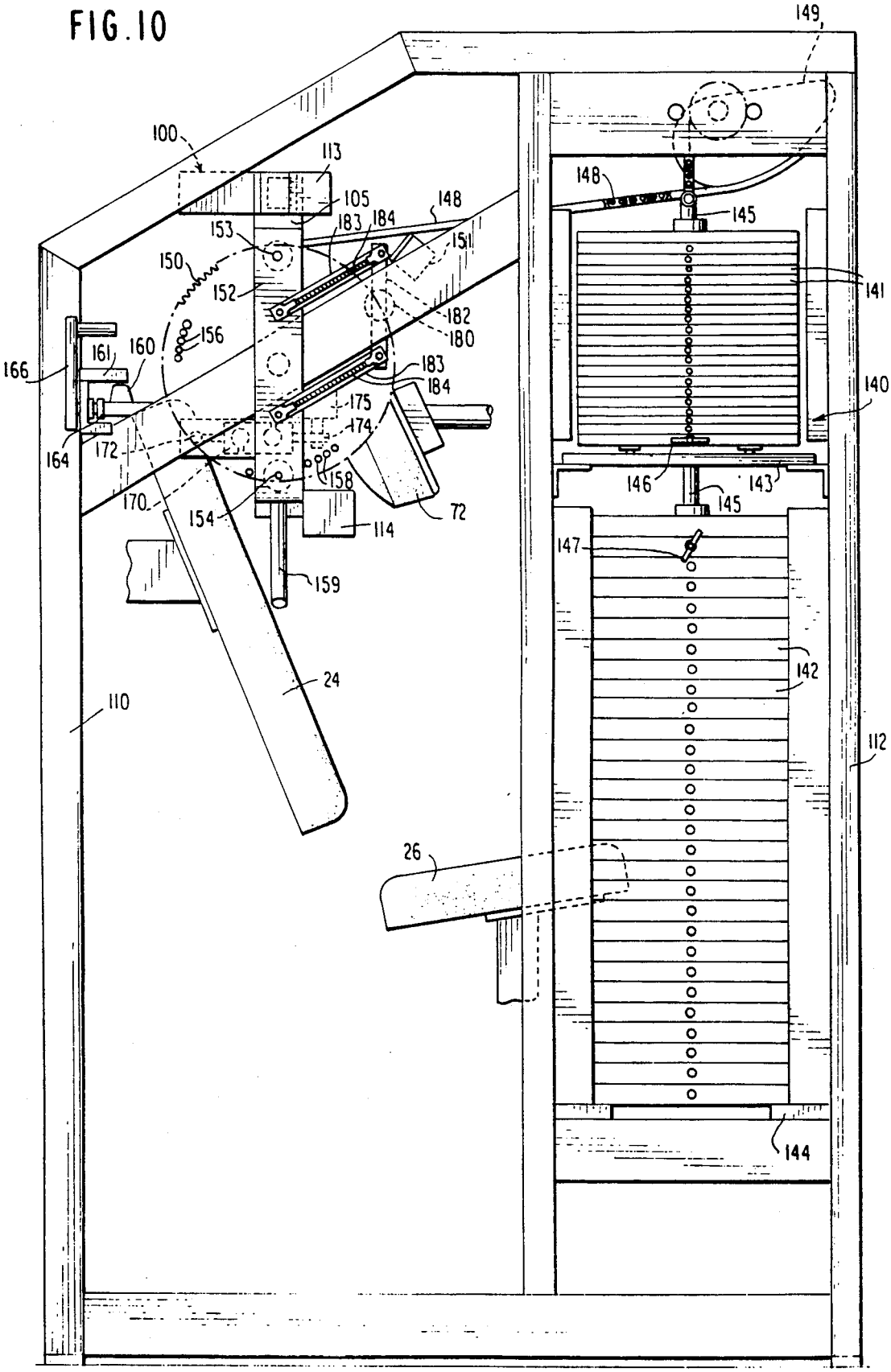

FIG. 2*a* is a fragmental plan view of a movement arm included in the apparatus;

FIG. 3 is a front elevational view of the apparatus as shown in FIG. 2;

FIG. 4 is a plan view of the apparatus as shown in FIG. 2 while also showing a front pad assembly in open position in dotted lines;

FIG. 5 is a detail elevational view of a latch mechanism included in the apparatus;

FIG. 6 is a fragmental side, elevational view of the apparatus as would be seen from the upper right-hand side of FIG. 3 and with certain parts removed;

FIG. 7 is a fragmental, rear, elevational view of the apparatus as would be seen from the upper right-hand side of FIG. 3 and with certain parts removed;

FIG. 7 is a fragmental, rear, elevational view of the apparatus as would be seen from the right-hand side of FIG. 6;

FIG. 8 is a fragmental view of the apparatus shown in FIG. 6 but as would be seen from looking out from the inside of the apparatus;

FIG. 9 is a fragmental cross-sectional view taken generally along lines 9—9 of FIG. 7; and FIG. 10 is a side elevational view as seen from the right-hand side of the apparatus and with certain parts removed for clarity.

DETAILED DESCRIPTION

The method and apparatus of the present invention is used to test the static strength of the cervical muscles of a human neck which muscles are associated with the seven cervical vertebrae. The method and apparatus are also used to conduct a dynamic test and/or exercise of the cervical muscles between opposite positions of full extension and flexion.

THE SEAT AND BACKREST

Figure 1:
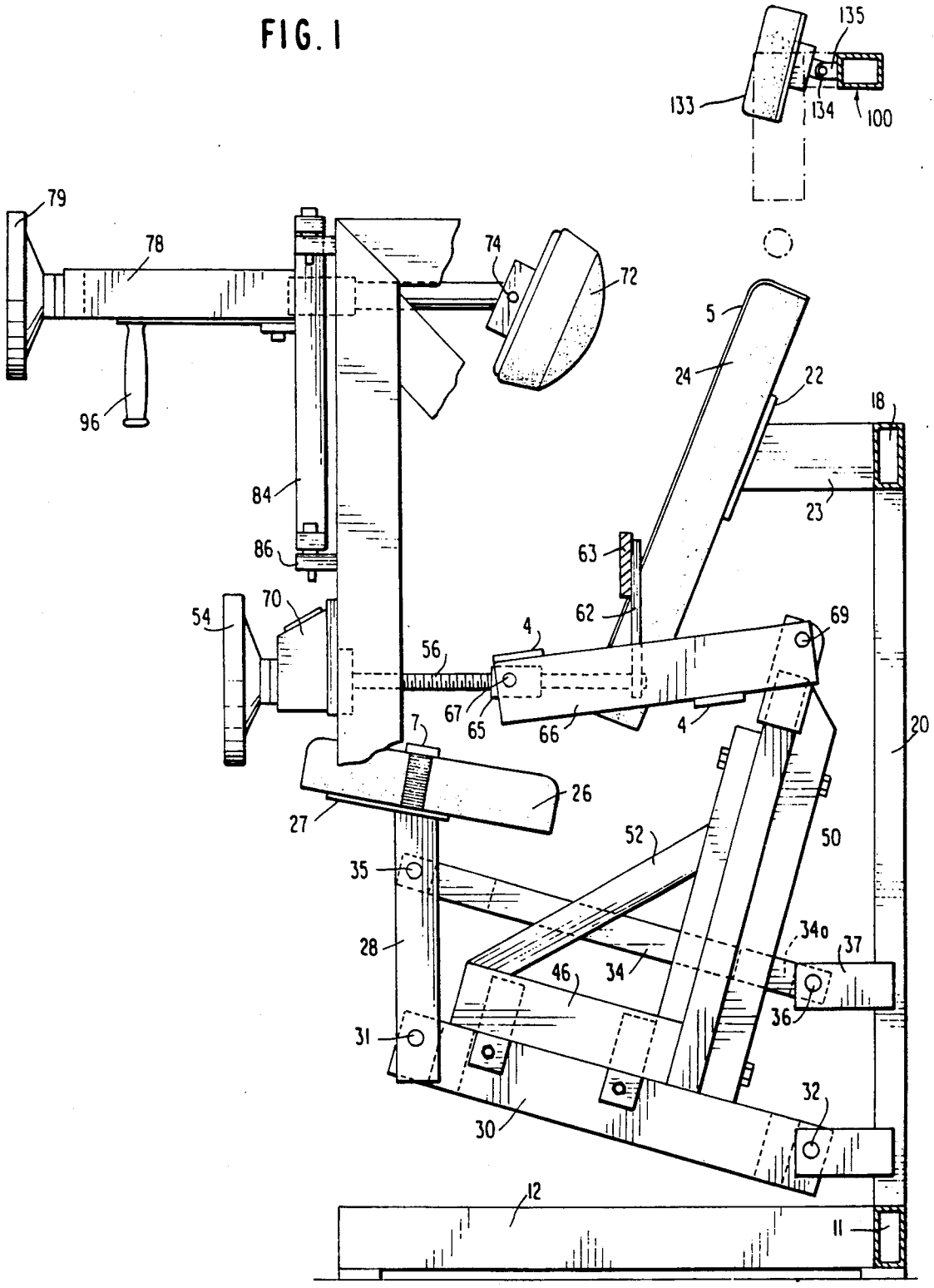
FIG. 1 is a side, elevational view of apparatus constituting a preferred embodiment of the invention as seen from the left-hand side of the apparatus and with certain parts broken away or removed for clarity purposes.

Referring to the drawings in detail, an apparatus constituting a preferred embodiment of the invention is disclosed for carrying out the aforementioned tests and exercises of the present invention. Referring to FIGS. 1, 3 and 4, the apparatus includes a structural steel center frame including a base including front and rear parallel members 10 and 11 interconnected by side members 12 and 13. Upstanding from the opposite ends of the rear base frame member 11 are vertical members 14 and 16 interconnected at their upper end portions by a horizontal member 18 as shown in FIGS. 3 and 4. Fixed to the center frame is a seat and backrest frame including a pair of parallel vertical members 20 fixed at opposite ends thereof to center frame members 11 and 18 as shown in FIGS. 1 and 3. Referring to FIGS. 1 and 3, a backrest bracket plate 22 is fixed at an angle to the upper frame member 18 by arms 23, and a suitable pad 24 is fixed to bracket plate 22 in the angular position shown in FIG. 1. To secure the torso of a subject against the backrest, a shoulder harness 5 shown in FIG. 1 is secured to the backrest 24.

Referring to FIG. 1, a seat 26 including a pad fixed to a bracket plate 27, is mounted to the vertical frame members 20 by means of a linkage including a vertical seat link 28 fixed to the bracket plate 27 and depending vertically therefrom. Seat 26 is provided with a seat belt 7 to further secure the subject in fixed position on the seat 26 and against the backrest 24. The linkage further includes a main support link 30 having a forward end pivoted by pivot 31 to the lower end of seat link 28 and a rear end pivoted by pivot 32 to an arm 33 fixed to vertical frame member 20. Completing the linkage is a control link 34 located above and parallel to the main support link 30 while having its forward end pivoted by pivot 35 to the seat link 28 and its rear end pivoted by pivot 36 to an arm 37 fixed to the vertical frame member 20. A four bar parallelogram linkage is thus formed between pivots 31, 32, 35 and 36 with one bar, between pivots 32 and 36, being fixed and the other bars being movable while the seat link 28 always remains in a vertical orientation. In this manner, the seat 26 is mounted to be adjustable into a desired horizontal position to suit the size of the subject. As shown in FIG. 3, there are two such four-bar linkages under opposite sides of the seat and they are interconnected by suitable torque bars 38, 39 and 40 connected between seat links 28 to integrate the linkages and provide added support.

Referring to FIGS. 1, 3 and 4, the seat linkage is actuated to and held in the desired position by means of a mechanism including a cantilever beam formed by a pair of beams 42 and 44 fixed in parallel to the main support links 30 of the seat linkages and projecting from the right side (as viewed in FIG. 4) where they are interconnected at their ends to a cross beam 46. The cantilever beam further includes a vertical arm generally designated 50 and shown as a composite structural member including three beams secured together and rigidly fixed to the lower cantilever beams 42, 44, 46 and with diagonal braces 51 and 52 fixed between the arm 50 and the lower cantilever beams.

Cantilever arm 50 is capable of being rocked forwardly or rearwardly to actuate seat linkage for adjusting the elevation of the seat 26 by means of a handwheel 54 fixed to the outer end of a threaded rod 56 which is journalled in a side frame generally designated 60. The latter is secured to the left side of the center frame as shown on the right-hand side of FIG. 3. As shown in FIG. 3, side frame 60 includes, at its front, a pair of vertical columns 61 interconnected by horizontal frame members including member 58 in which threaded rod 56 is journalled for rotation at one end thereof. As shown in FIGS. 1 and 4, the opposite end of threaded rod 56 is journalled for rotation in a bracket plate 62 fixed to and depending from a cross bar 63. The latter is fixed to and between diagonal beam braces 64 of side frame 60 as shown in FIG. 2.

As shown in FIGS. 1 and 2, threaded rod 56 is provided with a threaded nut 65 which is movable along the rod 56 upon rotation of the rod 56 by handwheel 54. Movement of nut 65 is transmitted to the cantilever arm 50 to actuate the same by means of a connecting link shown in FIG. 4 as formed by a pair of elongated plates 66 interconnected by plates 4 having their forward ends pivotally connected to nut 65 by pivot 67 and their rear ends pivotally connected by pivot 69 to a pair of ears 68 fixed at the top of the cantilever arm 50. It will be seen that rotation of the threaded rod 56 in one direction will move the connecting link 66 rearwardly to pivot the cantilever arm 50 and the seat linkage 30 and 34 in a clockwise direction as shown in FIG. 1 to raise the seat 26. Rotation of the rod 56 in the opposite direction will pivot the cantilever am 50 and the linkage 30 and 34 in the counterclockwise direction as viewed in FIG. 1 to lower the seat 26; the lowermost position of the linkage and seat being shown in FIG. 3. A digital register 70 is preferably provided behind the handwheel 54 to indicate the elevation of the seat 26.

FRONT PAD ASSEMBLY

In order to immobilize the upper torso including the upper arm portions of the subject while seated and against the backrest 24, a front pad assembly is provided at the front of the center frame. Referring to FIGS. 2 and 4, the assembly includes a pair of laterally spaced pads 72, shown as generally circular in outline and mounted to the ends of a pair of rods 73 by means of pivot pins 74 which allow the pads 72 to pivot in self-adjustment about horizontal axes to conform to the contour of the subject's body in the region of the chest and shoulders and including the upper arm portions. The diameter of the pads is therefore sufficiently great to provide the necessary coverage to ensure immobilization of the aforesaid torso parts. Rods 73 are mounted for slidable and rotatable movement in bushings 75 fixed to horizontal frame member 76. The latter is included in a generally rectangular frame including a front member 77 fixed in parallel to the frame member 76 by side members 78. Rotatably mounted at its opposite ends in the frame members 76 and 77 is a threaded rod 80. Mounted on the threaded rod 80 is a yoke 81 having rotatably mounted in the opposite ends thereof through washers 82, the ends of pad rods 73. A nut 83 threaded on rod 80 is fixed to yoke 81 so that rotation of rod 80 will cause the yoke 81 to advance or retract along rod 80 to advance or retract the pads 72. A handwheel 79 is fixed to threaded rod 80 to rotate the rod. In adjusting to the contour of the subject's body, the pads 72 are rotatable about the longitudinal axes of the rods 73 as well as about the axes of the pivots 74.

The front pad assembly frame is mounted to be swung between inoperative or open position shown in dotted lines in FIG. 4 to operative or closed position shown in solid lines in FIG. 4. In the shown embodiment this is achieved by a vertical frame member 84 fixed to frame member 76 and pivoted by pivots 85 in ears 86 fixed to the side frame members 61 as shown in FIGS. 2 and 3.

Referring to FIGS. 4 and 5, a latch mechanism is provided to releasably secure the front pad assembly in operative position. In the specific embodiment shown, the latch mechanism includes a latch pin 90 mounted on a lever 91 which is pivoted at 92 to frame 76. Latch pin is slidably received in frame members 78 and **78*a* for movement into and out of a keeper 93 fixed to a right side frame shown in dotted lines on the left hand side of FIG. 4. Latch pin 90 is biased to extended position by a coil spring 94 received about latch pin 90 between a stop pin 95 fixed to latch pin 90 and frame member 78*a*. A handle 96 is fixed to latch pin 90** to retract the same.

MOVEMENT ARM

Referring to FIGS. **2*a*, 3 and 7, a movement arm generally designated 100 is mounted above the seat for rotation about a generally horizontal axis. This mounting is effected on the left-hand side of the apparatus by a pivot shaft 101 mounted in bearing blocks 102 fixed to the members 61 of the left-hand side frame 60 as best shown in FIGS. 6 and 7. As shown in FIGS. 2*a* and 3, movement arm 100 includes an elongated upper yoke portion 104 which extends from side-to-side over the center frame, and opposite depending legs 105 which are secured by bolts and plates 106, 106*a* to leg extensions 107; the left-hand extension 107 being shown in FIGS. 7 and 8 as mounted on pivot shaft 101 for rotation about the latter. The leg extension 107 on the left-hand side of the movement arm 100 is used to act as a counterweight below the pivot shaft 101 to counterbalance the mass of the movement arm above the pivot shaft 101. To this end, the lower end of leg extension 107 is provided with a transversely extending cross portion 107*a* to provide the necessary counterbalancing mass. In the preferred embodiment, a small adjustable counterweight 108 is provided on a threaded rod 109 adjustably received in cross portion 107*a*** to allow precise final tuning of the counterweight during assembly to compensate for any imbalances that may result from the manufacturing process including welds, paint, etc.

The right-hand end of movement arm 100 is shown in FIG. 10 and includes a leg extension rotatably mounted about a pivot shaft **101*a* of the movement arm which shaft 101*a* is suitably mounted to a right-hand frame including vertical members 110, 111, and 112. The right-hand frame is, of course, secured to the right-hand side of the center frame. The right hand end of the movement arm is provided with counterweights 113 and 114** to ensure that the movement arm is balanced with respect to the axis of rotation of the movement arm.

ADJUSTABLE COUNTERWEIGHT ASSEMBLY

In order to counterbalance the mass of the subject's head and neck to ensure accurate measurement of the strength of the cervical muscles, an adjustable counterweight assembly is also provided. In the preferred embodiment shown in FIGS. 7 and 9, this assembly includes a counterweight mounting or carrier frame including a pair of vertical plates 115 mounted about pivot shaft 101 and joined at their upper and lower ends by cross plates 116. Mounted in the cross plates 116 are a pair of vertical guide rods 117 and 118 which extend through upper and lower plates 119 which hold a pair of counterweights 120 positioned on opposite sides of the pivot shaft 101 between the planes of the plates 115 of the carrier frame. One of the guide rods, namely 117 is threaded and received in a nut 121 fixed to the bottom crossplate 119 which holds the counterweights 120. A handwheel 122 is provided above cross plate 116 where it is secured to the top of threaded rod 117 such that rotation of the handwheel 122 will cause the nut 121 and the cross plate 119 fixed thereto to move up or down on the rods 117, 118 depending on the direction of rotation of handwheel 122. This, of course, will serve to adjust the vertical position of the counterweights 120 towards or away from the pivot shaft 101 of the movement arm 100. The vertical position of the counterweights is preferably indicated by a pointer 123 fixed to one of the counterweights 120 to read a scale 124 fixed to one of the plates 115 as shown in FIG. 6. Also in the preferred embodiment, a counterweight 125 shown in FIGS. 6 and 9 is fixed to the underside of the handwheel 122 to balance the handwheel 122 and a counterweight (not shown) is fixed to the counterweight carrier frame 115, 116 to balance the same.

In order to releasably secure the adjustable counterweight assembly to the movement arm 100, there is provided a lock mechanism which, in the preferred embodiment shown, includes a locking or brake disc 126 fixed to the movement arm through bolts received through apertures 127 (FIG. 8) in the leg 105 of the movement arm 100. Locking disc 126 is provided with an arcuate slot 128 for receiving a brake shaft 129 mounted through plates 115 and having a pair of brake caliper pads 130 engaging the opposite sides of locking disc 126 adjacent the slot 128 as shown in FIG. 7. Brake shaft 129 is actuated by a hand lever 131 (FIG. 6) pivotally connected to the end of the shaft 124 to cam the shaft to the right or left to either release or engage the caliper pads 130 relative to the locking disc 126. When the caliper pads engage the locking disc 126, the adjustable counterweight assembly will be locked to the movement arm 100 to provide the necessary counterbalance for the head and neck of the subject.

In order to accurately achieve precise counterbalancing, the angular position about the pivot shaft 101 of the counterweights may also be adjusted. This is achieved when the caliper pads 130 are disengaged or released from the locking disc 126, by rotating the entire counterweight assembly about the pivot shaft 101 until the necessary counterbalance is achieved and then engaging the caliper pads 130 against the locking disc 126.

HEADREST

During an exercise or test as will be described below, the subject will be seated in the apparatus with his body below the neck properly secured and immobilized and he will, with his cervical muscles, press his head against the movement arm. For this purpose, a headrest in the form of a pad 133 is pivotally mounted by pins 134 to ears 135 fixed to the movement arm as shown in FIGS. 1 and 3. The headrest 133 is located in the center of the movement arm 100 as shown in FIG. 3, and in the preferred embodiment, a bracket 136 containing the pivot pins 134 is connected to the rear of the headrest 133 and suitably weighted to balance the mass of the headrest 133. It is also preferred that the headrest 133 be contoured to the back of the head to help fix the position of the head relative to the movement arm 100.

RESISTANCE WEIGHT FOR LOADING THE MOVEMENT ARM

Referring to FIG. 10, the movement arm 100 is adapted to be connected to a resistance in the form of weights provided in a compound weight stack generally designated 140 shown on the right-hand side of FIG. 10. The compound weight stack includes upper and lower stacks of weights 141 and 142 respectively supported independently of each other on stationary plates 143, 144 located in the side frame between columns 111 and 112. An elongated connecting rod 145 extends vertically through apertures in both of the stacks 141, 142. Connecting pins 146 and 147 serve to independently connect any of the weights of the first and second stacks 141 and 142 to the connecting rod 145 such that all weights above the connected weight will be movable with the connecting rod 145. The top of connecting rod 145 is connected to a cable or chain 148 trained about a cam 149 rotatably mounted in the stack frame. The weights 141 of the upper stack are each less in magnitude than the weights 142 of the lower stack to allow precise weight selection to suit the strength of the cervical muscles of the subject. In the preferred embodiment, each of the weights 141 of the upper stack i one pound while each of the weights 142 of the lower stack is twenty pounds. In the preferred embodiment, each of the weights 141 of the upper stack is one pound while each of the weights 142 of the lower stack is twenty pounds. A more detailed description of a similar compound weight stack may be obtained from my copending application Ser. No. 07,181,372 identified above and whose disclose is incorporated by reference into the present application as part hereof.

The sprocket chain 148 from the weiqht stack is adapted to be connected to the movement arm 100 through means of a sprocket 150 mounted to the pivot shaft 101*a* of the movement arm on the right-side thereof. The sprocket chain 148 is trained about the sprocket 150 and fixed thereto such that rotation of the sprocket by the movement arm 100 in one direction as will be described below will impose a pull on the sprocket chain 148 to lift the connecting rod 145 and any weights 141, 142 connected thereto, and rotation of the sprocket 150 in the opposite direction will release tension on the chain 148 allowing the weights 141, 142 to descend. The system is calibrated such that the maximum stroke of the weights 141, 142 will be on the order of one and one-half inches (1½) to substantially reduce the kinetic energy of the weights to an extremely safe level to avoid any injury to the neck muscles. The maximum limit of forward travel of the movement arm 100 may be positively determined and set through a stop 151 fixed to the frame to be engaged by the leg of the movement arm 100.

DRIVE TRANSMISSION BETWEEN RESISTANCE WEIGHT AND MOVEMENT ARM

In order to releasably connect the movement arm 100 and sprocket 150 and, in turn, the compound weight stack 140, a drive transmission in the form of a toggle assembly is provided including a toggle lever 152 pivotally connected at an intermediate location thereof to the end of the pivot shaft 101*a*. On opposite end portions of toggle lever 152 are fixed pins 153 and 154 for alternate receipt in one of a plurality of upper and lower apertures 156, 158 provided in sets through upper and lower sections of the sprocket 150 with the sets being symmetrically positioned in order to maintain the balance of the sprocket 150. In the preferred embodiment, the angular spacing of the apertures in each set is six degrees (6°) and the angular spacing of an aperture in one set from the next adjacent aperture in the other set is three degrees (3°). The total range off the apertures provided by both sets is one hundred and twenty-six degrees (126°). Thus, the angular position of the movement arm may be changed in three degree (3°) increments over a range of one hundred and twenty-six degrees (126°). The various angular positioning of the movement arm 100 is used for conducting static strength tests of the cervical muscles as will be described below.

In order to engage the upper toggle pin 153 in any of the sprocket apertures 156 of the upper set, the toggle lever 152 is pivoted about the shaft 101*a* in one direction, and to engage the lower toggle pin 154 in any of the apertures 158 of the lower set, the toggle lever is pivoted about shaft 101*a* in the opposite direction. A handle 159 is fixed to the toggle lever 152 to pivot the lever 152. When both toggle pins 153 and 154 are removed from the upper and lower apertures 156, 158, the movement arm 100 will be free to rotate with the toggle lever 152. The range of movement of the sprocket in the clockwise direction as viewed in FIG. 10 is preferably limited by a stop arm 160 fixed too the sprocket 150 and projecting radially therefrom to be engageable with a stop 161 fixed to the frame. For the dynamic exercise or test mode of the apparatus, the range of movement of the sprocket 150 and the movement arm 100 when connected thereto may also be selected by positioning the toggle pin 153 or 154 in the appropriate sprocket aperture 156 or 158.

During testing of the static strength of the cervical muscles, it is necessary to fix the movement arm 100 against rotation. This is accomplished by inserting one of the toggle pins 153 or 154 in an appropriate aperture 156 or 158 in the sprocket 140 and preventing rotation of the sprocket 150. The latter is accomplished in the shown embodiment by an extendable and retractable stop generally designated 164 which is brought into engagement below stop arm 160 on the sprocket 150 so that the stop arm 160 is captured between stops 161 and 164. Stop 164 is mounted for slidable movement on frame 110 between extended and retracted positions, and a lever 166 is connected to the stop 164 to actuate the same between its positions.

During a test of the static strength of the cervical muscles, the strength at each angular position of the movement arm 100 is measured through the use of a suitable instrument such as an electronic strain gauge 170 which may be a universal load cell. One end of the strain gauge 170 is connected at 172 to the toggle lever assembly through an arm 173 connected to the toggle lever 152 through a keeper box (not shown) which receives the toggle pins 153 and 154. The other end of the strain gauge 170 is connected at 174 to a member 175 fixed to the leg of the movement arm 100. The readings of the strain gauge 170 are visually displayed on a video screen and printed through suitable processors and equipment. It should also be noted that the strain gauge 170 also serves as a drive connection between the movement arm 100 and the toggle assembly.

The angular position of the movement arm 100 is also measured and displayed in a video screen and recorded through suitable equipment connected to a potentiometer generally designated 180 having a fixed portion fixed to a stationary frame part 181 and a rotatable shaft mounted to a link 182 to rotate with the toggle lever 152 and movement arm 100. Link 182 has its opposite ends pivotally connected to parallel links 183 which are pivotally connected to toggle lever 152 on opposite sides of pivot shaft 101*a*. The linkage is held in position by tension springs 184 extending along links 183 and connected at their opposite ends to the pivots between the links 183 and the toggle lever 152 and link 182. It will be seen that rotation of the toggle lever 152 will cause the potentiometer shaft to rotate with link 182 to measure angular position of the movement arm 100 when connected to the toggle lever 152 by either of the toggle lever pins 153 or 154. The potentiometer 180 is calibrated to read zero when the movement arm is in the ninety degree (90°) position, that is, when the movement arm extends ninety degrees (90°) to horizontal plane. Therefore, angular readings from the potentiometer mean angular degrees to either side of the zero degree position.

A further description of a toggle assembly as shown herein and described above may be gained from my copending application Ser. No. 07,236,367 identified above which is incorporated by reference herein as part of this application.

SUMMARY OF OPERATION AND METHODS

To summarize operation of the machine in accordance with preferred methods of the present invention, the following preliminary preparation is first undertaken. The subject is first seated on the machine and to do this, the front pad assembly frame is swung to the open position shown in dotted lines shown in FIG. 4 to provide access to the seat and backrest. Preferably, the seated subject is secured against the seat by means of seat belt 7 and against the backrest by means of shoulder harness 5. The seat 26 is then adjusted by means of the seat linkage and handwheel 79 to place the subject in the elevation where the back of the subject's head is engaged against the headrest 133. The elevation of the seat 26 is noted from the register 70 and recorded so that in subsequent tests, the subject may be seated at the same elevation. The front pad assembly frame is then moved to the closed position shown in solid lines in FIG. 4 and the horizontal position of the pad rods 73 is adjusted through means of the handwheel 79 to engage the upper torso in the region of the chest and shoulders. In addition, the front pads 72 are free to rotate about the rods 73 and also about the pivots 74 to bring the pads 72 into proper conformity with the subject's body at the chest and shoulder areas thereby immobilizing the subject's body from the neck downwards.

Next, the mass of the head and neck of the subject are counterbalanced through use of the adjustable counterweight assembly. To do this, the position of the head and neck are brought into the top center position, that is, where the movement arm 100 extends generally ninety degrees (90°) to the horizontal. This position may be indicated by a bubble level incorporated on the movement arm. The movement arm 100 is then locked to the counterweight assembly by the lever 131 which actuates the calipers 130 into engagement with the brake disc 126 secured to the movement arm. Using the handwheel 122, the movable counterweights 120 are raised or lowered as required until the mass of the head and neck is counterbalanced by the counterweights relative to the horizontal pivot shaft axis of the movement arm. When this condition occurs, a register such as a digital register associated with the handwheel and the adjustable counterweight assembly, will read zero, thus telling the operator of the machine that the counterbalance has been achieved.

Preferably, the next preliminary preparation for use of the apparatus, is to preferably determine the range of movement of the subject's head. This is effected by having the subject move and bend his head forwardly as far as possible and then backwardly as far as possible. During this step the movement arm is, of course, disengaged from the resistance weights 140. Once the range of movement is determined, it will tell the operator the range of head and neck positions in which to conduct the static and dynamic tests or exercise.

The subject is now ready to be tested or exercised with the machine. With new subjects, it is preferred that the static strength of the subject's cervical muscles first be tested. This is effected by first immobilizing the subject's torso including the shoulders and upper arm portions from the neck down as described above, and then locking the movement arm 100 against movement by inserting one of the pins 153 or 154 into one of the apertures 156 or 158 of sprocket 150 and extending the stop 164 to engage the stop arm 160 on the sprocket 150. The subject then begins the test by exerting with the cervical muscles a force on the movement arm 100 through engagement of the subject's head against the headrest 133. The amount of force exerted will be measured by the strain gauge 170 and through the use of a computer, the measurement is recorded and displayed on a video screen such as in the form of a bar graph which gives the force per angular position of the head. The angular position of the head is determined by the potentiometer 180 which reads the angular position of the movement arm. The strength test is repeated at each of several different angular positions of the head as desired. The angular positions are achieved by removal of the toggle pin 153 and 154 from the sprocket 150, rotation of the toggle lever 152 to the desired position and reinsertion of the pin 153 or 154 into the appropriate aperture in the sprocket 150. At the conclusion of a test, a bar graph including a printed version of the graph will show the static strength of the subject's cervical muscles in each of the various angular positions of the head. This is also used to determine the magnitude of resistance weight to be employed in the dynamic exercise or test now to be described.

In the dynamic exercise of the cervical muscles, the subject, while his body below the neck is immobilized as discussed, is asked to move the movement arm 100 rearwardly by applying force with the cervical muscles to press the subject's head against the headrest 133. The rearward movement of the movement arm 100 is yieldingly opposed by a resistance in the form of a freely movable weight which, in the preferred embodiment, is provided by the compound weight stack 140 described above. After pivoting the movement arm 100 rearwardly with his neck muscles in extension, the subject then bends his neck forwardly in flexion whereupon the resistance weight will descend. The subject is asked to repeat the above steps gradually and continually until he can no longer move the movement arm 101 rearwardly. At that point, the test is concluded. It is important to note that the weight chosen from the compound weight stack 141 for use in the dynamic exercise of the cervical muscles is chosen to be safely less than the static strength of the cervical muscles which, of course, was determined by the test static strength described above. In addition, it is noted that the compound weight system and sprocket assembly is designed and adjusted so that the maximum stroke of the weights 141 and/or 142 during the exercise is no greater than about one and one-half inches (1½). This substantially reduces the kinetic energy that can be achieved by the resistance weights 141 or 142 when the subject relieves pressure on the movement arm and bends his head forwardly causing the resistance weights to descend. In this way, the dynamic exercise is ensured to be safe and injury to the neck muscles or vertrabrae is avoided.

In order to adapt the apparatus for use in exercising the cervical muscles, the toggle lever 152 is connected by either pin 153 or 154 to the appropriate sprocket aperture 156 or 158 in accordance with the range of movement of the subject which was established in the preliminary preparation steps described above. Insertion of the toggle pin into one of the sprocket apertures operatively connects the movement arm 100 to the sprocket 150 and thereby connects the movement arm to the compound weight stack 140. A safe resistance weight combination is chosen from the compound stack weights 141 and 142 and the keys 147 and 147 are inserted into the connecting rod 145 to thus operatively connect the resistance weights to the sprocket chain 148. The movable stop 164 is then retracted from the stop arm 160 of the sprocket 150 to enable the sprocket 150 and the movement arm 100 to be rotated during the exercise. During the exercise, the number of repetitions is measured such as by an electronic switch which cooperates with a recorder and printer to record the number of repetitions and to print it.

After the subject completes the dynamic exercise, it is preferred, for a new subject that he again be subjected to a static strength test in the same manner described above, to determine the effect of the dynamic exercise on the static strength of the subject's cervical muscles. Comparison of the subject's static strength immediately before and immediately after dynamic exercise gives meaningful information as to the type and condition of the subject's muscles and the type of exercise appropriate to the muscles.

It will thus be seen that the methods and apparatus of the present invention test and exercise the cervical neck muscles with a very high degree of control and accuracy so that meaningful results may be achieved and recorded. This enables any defects in the condition of the muscles to be uncovered with accuracy while also permitting rehabilitation exercises to be designed to suit the fiber-type and condition of the muscles. The dynamic exercise of the present invention will be effective to rehabilitate and/or strengthen the muscles in a way that is very safe and guards against injury to the muscles. Finally, it is noted that the apparatus of the present invention may be safely and accurately operated by a technician without requiring any special skills.

While preferred embodiments of the present invention have been shown and described, it will be understood that the scope of the invention will be described in the following claims.

I claim:

1. Apparatus for exercising and/or testing cervical muscles of the neck of a human body, the apparatus comprising in combination, a seat for receiving a person in seated position, a movement arm above the seat having a head rest engageable by the head of a person to move the movement arm about a generally horizontal first axis through exertion of said muscles, said head rest being pivotally mounted to the movement arm for movement about a generally horizontal second axis generally parallel to said first axis relative to the movement arm, and resistance means connected to said movement arm to impose a resistance to movement of the movement arm in one direction.

2. Apparatus defined in claim 1 wherein said resistance means is a dead weight.

3. Apparatus defined in claim 1 wherein said head rest is balanced about said second axis.

4. Apparatus for exercising and/or testing cervical muscles of the neck of a human body, the apparatus comprising in combination, a seat for receiving a person in seated position, a movement arm above the seat having a head rest engageable by the head of a person to move the movement arm about a generally horizontal first axis through exertion of said muscles, said head rest being pivotally mounted to the movement arm for movement about a generally horizontal second axis generally parallel to said first axis relative to the movement arm, resistance means connected to said movement arm to impose a resistance to movement of the movement arm in one direction, and immobilizing means for immobilizing the person below the neck to isolate said muscles from the torso of the person.

5. Apparatus defined in claim 4 wherein said resistance means is a dead weight.

6. Apparatus defined in claim 4, wherein said head rest is balanced about said second axis.

7. Apparatus for exercising and/or testing cervical muscles of the neck of a human body, the apparatus comprising in combination, a seat for receiving a person in seated position, a movement arm above the seat engageable by the head of a person to move the movement arm about a generally horizontal first axis through exertion of said muscles, resistance means connected to said movement arm to impose a resistance to movement of the movement arm in one direction, said resistance means including a freely movable resistance weight to be moved by exertion of said muscles to move the head and movement arm in said one direction and to be moved when the head is moved in a direction opposite said one direction to return the movement arm, and means for limiting the stroke of said resistance weights on the order of one and one-half inches.

8. Apparatus defined in claim 7 including means including a strain gauge releasably connecting the movement arm to said resistance means.

9. Apparatus defined in claim 7 wherein said resistance weight is on the order of one pound.

10. Apparatus for exercising and/or testing cervical muscles of the neck of a human body, the apparatus comprising in combination, a seat for receiving a person in seated position, a movement arm above the seat engageable by the head of a person to move the movement arm about a generally horizontal first axis through exertion of said muscles, resistance means connected to said movement arm to impose a resistance to movement of the movement arm in one direction, and immobilizing means for immobilizing the person below the neck to isolate said muscles from the torso of the person, said resistance means including freely movable resistance weights to be lifted by exertion of said muscles to move the head rearwardly to move the movement arm in said one direction and to be lowered when the head is moved forwardly to return the movement arm, said resistance weights including a weight on the order of one pound, and means for limiting the stroke of said resistance weights on the order of one and one-half inches.

11. Apparatus defined in claim 10, including means including a strain gauge releasably connecting the movement arm to said resistance means.

* * * * *